US006672800B2

(12) United States Patent
Frank

(10) Patent No.: US 6,672,800 B2
(45) Date of Patent: Jan. 6, 2004

(54) PORTABLE FLOOD CONTROL REVETMENT

(75) Inventor: Thomas A. Frank, Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/084,745

(22) Filed: Feb. 22, 2002

(65) Prior Publication Data

US 2003/0161688 A1 Aug. 28, 2003

(51) Int. Cl.[7] ..... E02B 7/02

(52) U.S. Cl. ..... 405/115; 405/16; 405/91; 405/114

(58) Field of Search ..... 405/16–22, 32, 405/52, 91, 107, 113–115

(56) References Cited

U.S. PATENT DOCUMENTS

| | | | | | |
|---|---|---|---|---|---|
| 495,788 | A | * | 4/1893 | Debarle | 405/115 |
| 3,786,638 | A | * | 1/1974 | Fish | 405/115 |
| 3,849,989 | A | * | 11/1974 | Preus | 405/68 |
| 4,077,222 | A | * | 3/1978 | Larsen | 405/16 |
| 4,652,173 | A | * | 3/1987 | Kallestad | 405/69 |
| 4,657,433 | A | * | 4/1987 | Holmberg | 405/26 |
| 4,690,585 | A | * | 9/1987 | Holmberg | 405/19 |
| 4,889,446 | A | * | 12/1989 | Holmberg | 405/19 |
| 4,906,134 | A | * | 3/1990 | Hoyeck | 405/91 |
| 5,040,919 | A | * | 8/1991 | Hendrix | 405/91 |
| 5,577,455 | A | * | 11/1996 | Dvorak | 114/219 |
| 5,605,416 | A | * | 2/1997 | Roach | 405/21 |
| 5,645,373 | A | * | 7/1997 | Jenkins | 405/114 |
| 5,857,806 | A | * | 1/1999 | Melin | 405/115 |
| 5,865,564 | A | * | 2/1999 | Miller et al. | 405/115 |
| 5,984,577 | A | * | 11/1999 | Strong | 405/114 |
| 6,334,736 | B1 | * | 1/2002 | Johnson et al. | 405/114 |
| 6,364,571 | B1 | * | 4/2002 | Doolaege | 405/115 |
| 6,481,928 | B1 | * | 11/2002 | Doolaege | 405/115 |

FOREIGN PATENT DOCUMENTS

| | | | | |
|---|---|---|---|---|
| CH | 657884 | * | 9/1986 | 405/115 |

* cited by examiner

*Primary Examiner*—Jong-Suk (James) Lee
(74) *Attorney, Agent, or Firm*—James M. Kasischke; Jean-Paul A. Nasser; Michael F. Oglo

(57) ABSTRACT

A portable flood control revetment comprising an elongated collapsible and inflatable tube of flexible material impervious to air and water, the tube having a bottom wall and other walls defining an internal compartment, and a multiplicity of cables in the compartment, each extending from one of the walls to another of the walls to hold the tube in a selected shape when the tube is filled with air or water. The bottom wall defines at least one pocket for receiving a corresponding at least one hold-down member, and other of the walls are provided with closeable orifices for permitting flow of air and water into and out of the compartment to respectively inflate, fill, and collapse the tube.

16 Claims, 2 Drawing Sheets

PORTABLE FLOOD CONTROL REVETMENT

STATEMENT OF GOVERNMENT INTEREST

The invention described herein may be manufactured and used by and for the Government of the United States of America for Governmental purposes without the payment of any royalties thereon or therefor.

CROSS REFERENCE TO OTHER PATENT APPLICATIONS

Not applicable.

BACKGROUND OF THE INVENTION (1) Field of the Invention

The invention relates to the provision of levees and similar revetments for the control of flood water, and is directed more particularly to the provision of essentially portable revetments which may be rapidly deployed to and installed in areas of flood control need with relatively little labor.

(2) Description of the Prior Art

It has long been known that earthen levees or revetments of concrete, or the like, provide protection from floods, particularly along rivers and other waterways. However, weather often presents higher crests than such structures are designed to handle, or batters such structures, particularly earthen levees, until breaches occur, leading to flooding, causing immense damage and often loss of life of people and animals.

The repair of breached levees is extremely labor intensive, slow, expensive, and unreliable.

There is a need for a revetment which is collapsible and readily transportable to an area threatened with flooding by virtue of rupture of, or non-existence of, levees. There is further a need for such a revetment as can be relatively easily put in place where needed. A still further need is to provide such a revetment as can be erected, once in place, by relatively few people in quick order to provide a bulwark against rising river crests, high tides, and the like.

SUMMARY OF THE INVENTION

An object of the invention is, therefore, to provide a collapsible and transportable revetment susceptible to rapid transport to a threatened area.

A further object of the invention is to provide such a revetment as is easily placed where needed.

A still further object of the invention is to provide such a revetment as can be erected in short order, by a small number of people.

A still further object of the invention is to provide such a revetment which, once in place and erected, is adapted to stand against high water pressures of rising rivers or tides, or the like.

With the above and other objects in view, as will hereinafter appear, a feature of the present invention is the provision of a portable flood control revetment comprising an elongated collapsible and inflatable tube of flexible material impervious to air and water, the tube having a bottom wall and other walls defining an internal compartment, and a multiplicity of cables in the compartment, each extending from one of the walls to another of the walls to hold the tube in a selected shape when the tube is inflated with air or filled with water. The bottom wall defines at least one pocket for receiving a corresponding hold-down member, and at least one other of the walls is provided with a closeable orifice means for permitting flow of air and water into and out of the compartment to respectively inflate, fill and collapse the tube.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

Figure 1:
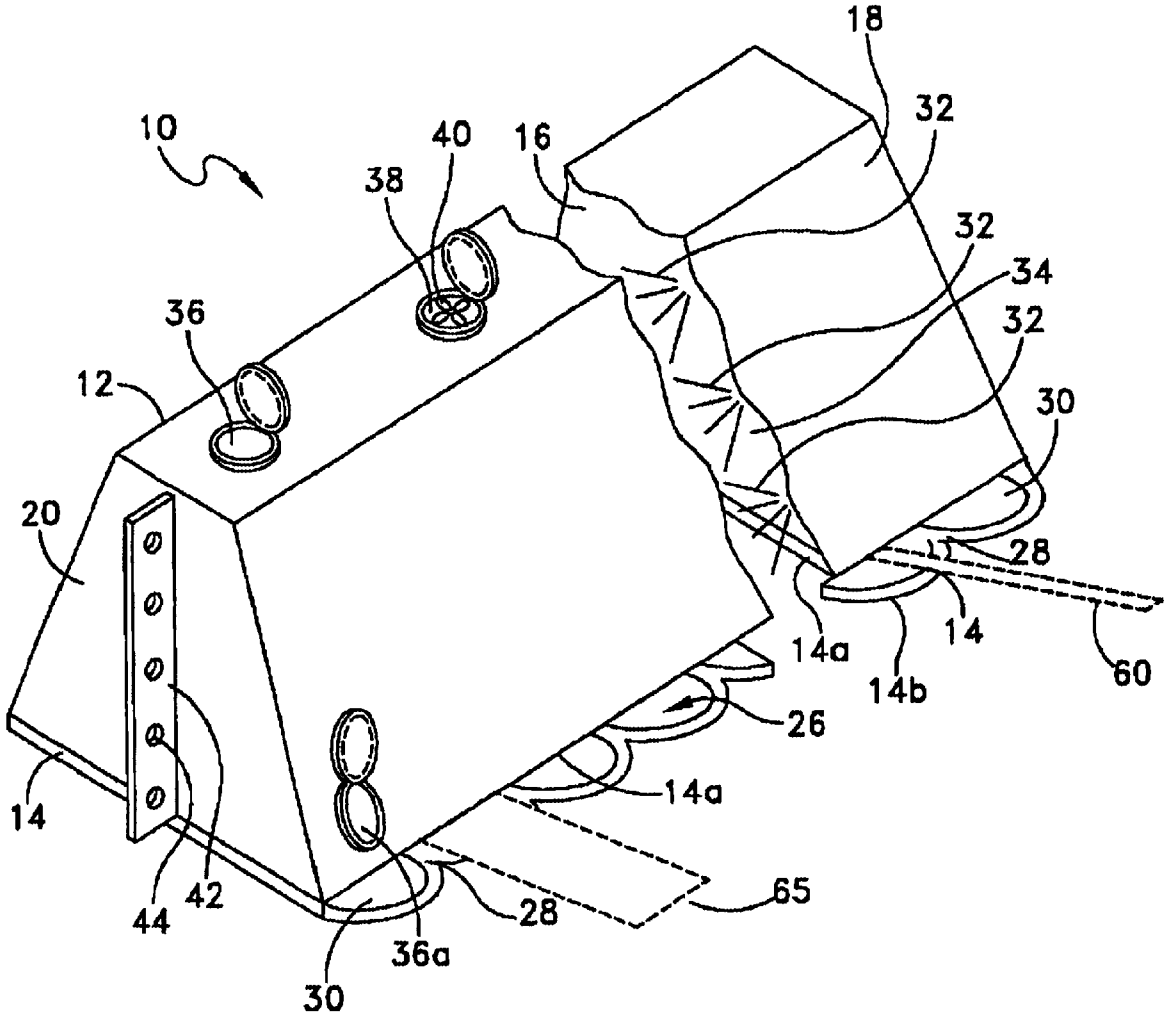
FIG. 1 is a diagrammatic interrupted perspective view of one form of revetment illustrative of an embodiment of the invention.
Figure 2:
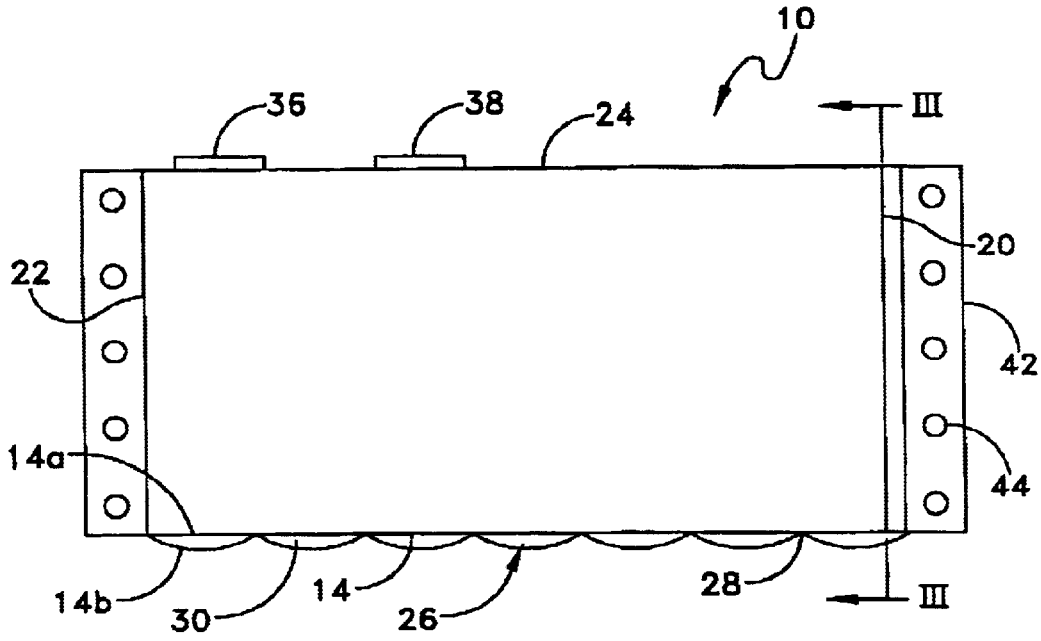
FIG. 2 is a frontal elevational view thereof.
Figure 3:
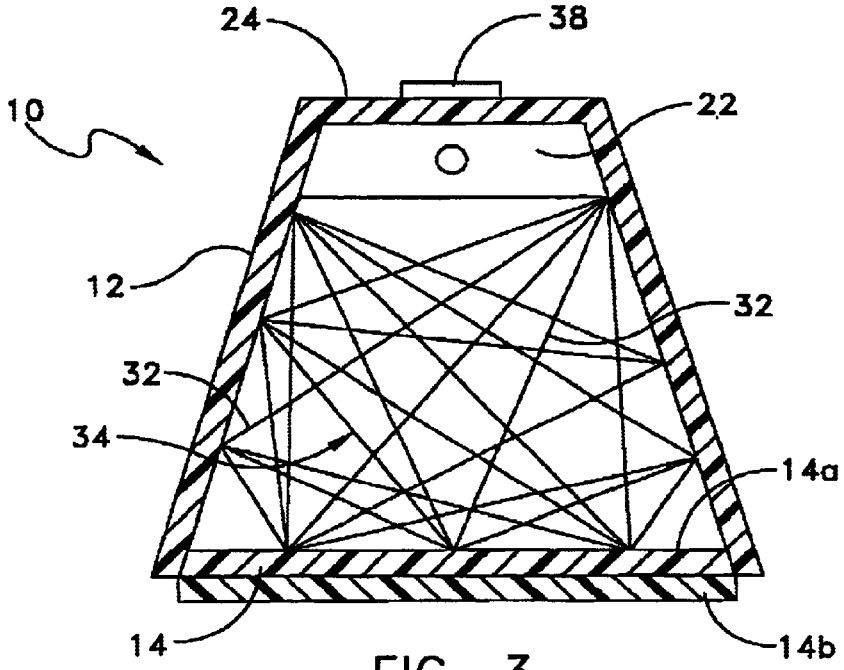
FIG. 3 is a cross sectional view taken along line III—III of FIG. 2.

Referring to the drawings, it will be seen that an illustrative revetment 10 includes a collapsible and inflatable tube 12, shown inflated in the drawings. The tube 12 is of a material impervious to air and water, such as a rubber or plastic material which may be fiber reinforced. The tube 12, when inflated with air or filled with water, exhibits a bottom wall 14 and other walls, such as side walls 16, 18, end walls 20, 22 and a top wall 24. It will be apparent that the side walls 16, 18 may be joined at the top (not shown), eliminating the need for the top wall 24.

The bottom wall 14 preferably is of two layers 14*a*, 14*b* with one or more spaces 26 therebetween. Partitions 28 interconnect the layers 14*a*, 14*b* to define pockets 30 for receiving hold-down structures such as heavy metal slabs 65, cable 60. The pockets 3 are open at each end thereof, such that hold-down structure may be slid into the pockets.

A multiplicity of cables 32 are fixed in a compartment 34 defined by the walls 14–24. Each cable 32 extends from one of the walls to another of the walls to hold the tube 12 in a selected configuration when the tube is inflated with air or filled with water.

At least one of the walls is provided with an inlet 36 for admitting water into the compartment 34. The inlet 36 may also serve as an outlet for the water, through which water may be pumped to a desired location. Preferably, another water outlet 36*a* is disposed in a side wall and proximate the bottom wall 14 to permit gravity draining of the compartment 34.

When inflated with air, the tube 12 expands to its desired configuration for use, but remains relatively light in weight and is susceptible to being moved into a flood control position. When filled with water, the tube 12 assumes the configuration dictated by the walls and cables 32 and is very heavy, sufficiently so to withstand the force of river or ocean water thereagainst.

The revetment 10 is further provided with an inlet/outlet 38 for admitting pressurized air into the compartment 34 and permitting the air to escape from the compartment, when desired. Preferably, the air orifice 38 is provided with a blower 40 for forcing air into the compartment 34.

The revetment 10 may be provided with flaps 42 at one or both ends thereof, the flaps 42 having apertures 44 therein to facilitate binding together of adjacent revetments, as by wire, cable, or chain.

In operation, the revetments 10, in collapsed and rolled condition, are transported to a threatened location. The revetments are unloaded, unrolled and while empty and relatively light in weight, are placed roughly where needed. The revetments are then inflated with air to assume their working configuration and size. If desired, revetments may be laced together, flap-to-flap, to provide a lengthy and extended revetment. When the revetments are properly positioned and connected, hold-down members are placed in the pockets 30 to secure the revetments in place and to resist revetments being displaced by high winds. Air inlet 38 is opened to allow air to escape and the water outlet 36 is opened and water is pumped into the compartment 34. The tube 12 is filled with the water and expands to the point at which it is restrained from further expansion by the cables 32. When filled, or nearly so, the ingestion of water is terminated and the water inlet 36 and air outlet 38 are closed.

Upon passing of the flood event, the water outlet 36 is opened and water is pumped out and, optionally, returned to the river or ocean proximate the revetment. Alternatively, the water may be allowed to drain out the water outlet 36*a*. When pumped out of the compartment 34, the water may be used for other purposes, such as firefighting, or, if the water is fresh water, for drinking water for people and/or animals.

There is thus provided a collapsible and transportable revetment susceptible to rapid transport to a threatened area, is easily placed where needed, can be erected in short order by a small number of people, and which, once in place and erected, is adapted to stand against high water pressures of rising rivers or tides, or the like.

While the above-described revetment has been described as useful in flood control situations, and while it is anticipated that an area of primary usage will be in flood control environments, it will be appreciated that the revetment can be used at forward deployed military sites to provide interim, rapidly assembled, protection for personnel. When filled with water, the revetment is highly effective against shrapnel and small arms fire, while being fireproof. Water leakage from small holes is slow and can be easily and quickly patched.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A portable flood control revetment comprising:

an elongated collapsible and inflatable tube of flexible material impervious to air and water, said tube having a bottom wall and other wall defining an internal compartment; and a multiplicity of cables in the compartment, each extending from one of the walls to another of the walls to hold said tube in a selected shape when said tube is inflated with air and filled with water;

the bottom wall defining at least one pocket capable of receiving a corresponding at least one hold-down member wherein the bottom wall comprises two layers spaced from each other with partitions extending therebetween to provide the pocket and a plurality of further pockets capable of receiviny the hold-down members; and at least one other of the walls having closeable orifice means for permitting flow of air into and out of the compartment and flow of water into and out of the compartment, to respectively inflate, fill and collapse the tube.

2. The revetment in accordance with claim 1 wherein the pockets are capable of receiving cables.

3. The revetment in accordance with claim 1 wherein the pockets are configured to receive slabs.

4. The revetment in accordance with claim 1 wherein the closeable orifice means comprises a water inlet/outlet disposed proximate the top of said tube.

5. The revetment in accordance with claim 4 wherein the closeable water inlet/outlet is disposed in a top wall of said tube.

6. The revetment in accordance with claim 4 wherein the closeable orifice means further comprises a water outlet disposed aproximate the bottom wall of said tube.

7. The revetment in accordance with claim 1 wherein the closeable orifice means comprises an air inlet/outlet orifice disposed aproximate the top of said tube.

8. The revetment in accordance with claim 7 wherein the revetment further comprises a blower mounted in the air inlet/outlet orifice for forcing air therethrough and into the internal compartment.

9. The revetment in accordance with claim 7 wherein the air inlet/outlet orifice is disposed in a top wall of said tube.

10. The revetment in accordance with claim 1 and further comprising a flap fixed to an end wall of said tube and extending in a top-to-bottom direction.

11. The revetment in accordance with claim 10 wherein said flap is provided with structure for interconnecting with the flaps of adjacent revetments.

12. The revetment in accordance with claim 10 wherein said flap is provided with apertures extending therethrough.

13. The revetment in accordance with claim 1 wherein the material comprises a plastic mateal.

14. The revetment in accordance with claim 1 wherein the material comprises a rubber material.

15. The revetment in accordance with claim 13 wherein said plastic material is fiber reinforced.

16. The revetment in accordance with claim 14 wherein said rubber material is fiber reinforced.

* * * * *